US006779456B2

(12) United States Patent
Avetisian

(10) Patent No.: US 6,779,456 B2
(45) Date of Patent: Aug. 24, 2004

(54) INITIATOR WITH A BRIDGEWIRE CONFIGURED IN AN ENHANCED HEAT-SINKING RELATIONSHIP

(75) Inventor: Vahan Avetisian, Newbury Park, CA (US)

(73) Assignee: Special Devices, Inc., Moorpark, CA (US)

( * ) Notice: Subject to any disclaimer, the term of this patent is extended or adjusted under 35 U.S.C. 154(b) by 0 days.

(21) Appl. No.: 10/188,010

(22) Filed: Jul. 1, 2002

(65) Prior Publication Data

US 2004/0000249 A1 Jan. 1, 2004

(51) Int. Cl.[7] ..... F42B 3/12
(52) U.S. Cl. ..... 102/202.9; 102/202.11; 102/202.5
(58) Field of Search ..... 102/202.5, 202.9, 102/202.14, 202.11, 202.7

(56) References Cited

U.S. PATENT DOCUMENTS 4,103,619 A 8/1978 Fletcher et al. ..... 102/28 R
5,454,320 A 10/1995 Hilden et al. ..... 102/202.7
5,686,691 A * 11/1997 Hamilton et al. ..... 102/202.5
5,821,446 A 10/1998 Chatley, Jr. ..... 102/202.7
5,889,228 A * 3/1999 Ewick et al. ..... 102/275.5
5,988,069 A * 11/1999 Bailey ..... 102/202.9
6,096,997 A * 8/2000 Shirk ..... 219/260
6,220,163 B1 * 4/2001 Duguet et al. ..... 102/202.2
6,305,286 B1 * 10/2001 Fogle, Jr. et al. ..... 102/202.5
6,408,759 B1 6/2002 Ewick et al. ..... 102/202.5
6,578,487 B2 * 6/2003 Avetisian et al. ..... 102/202.7

* cited by examiner

*Primary Examiner*—Peter M. Poon
*Assistant Examiner*—Timothy D Collins
(74) *Attorney, Agent, or Firm*—Law Offices of Thomas J. Brindisi

(57) ABSTRACT

A pyrotechnic initiator having a bridgewire configured in an enhanced heat-sinking relationship with the adjacent ignition charge and/or header glass surface without the necessity of a consolidation force.

18 Claims, 1 Drawing Sheet

INITIATOR WITH A BRIDGEWIRE CONFIGURED IN AN ENHANCED HEAT-SINKING RELATIONSHIP

BACKGROUND OF THE INVENTION

The present invention generally relates to the field of pyrotechnic initiators, and more particularly to a pyrotechnic initiator having a bridgewire configured in an enhanced heat-sinking relationship with the adjacent ignition charge and/or header glass surface.

Pyrotechnic initiators have many uses in industrial and consumer applications. One important use is in triggering the inflation of airbags in motor vehicles. Significant efforts have been made in the automotive industry to reduce the cost of manufacturing reliable airbag initiators. One advance has been the use of liquids and slurries in loading pyrotechnic charges into the initiators. As shown in U.S. Pat. No. 5,686,691 to Hamilton et al. (which is incorporated herein by reference for its disclosure of slurry-loading except to the extent that it contradicts anything explicitly set forth here), it is known to load a slurry charge into a can and place the can onto a header assembly under a high consolidation force (e.g., 1500 psi) so that the charge consolidates and forcefully presses against the header surface and bridgewire. It is not always desirable, however, to consolidate such charges. For one thing, consolidation tends to require a highly flush glass surface (because the extremely fine bridgewires typically used are easily damaged if pressed against irregularities or voids in the surface of the glass), which generally requires a machining or grinding step.

It is also known to apply a non-consolidated ignition charge to a bridgewire that is raised above a glass surface, with the non-consolidated charge being dried to form a monolithic solid that encapsulates the bridgewire. However, the thermal conductivity of such ignition charges is typically markedly lower than that of the glass in the header. Consequently, because the bridgewire is spaced apart from the glass, it has less of a heat sink available to it. The availability of a heat sink is in turn important because of its effect on the firing performance of the initiator. Specifically, a firing current having at least a predetermined "all-fire" level and duration (e.g., 800 mA for 2 milliseconds at −35° C.) applied to the bridgewire must resistively generate heat that is reliably (e.g., 99.9999% of the time with at least 95% confidence) sufficient to ignite the charge. It is also generally required that the application of current up to a predetermined "no fire" level and duration (e.g., 200 mA for 10 seconds at 85° C.) will reliably not result in the bridgewire generating sufficient heat to ignite the charge. The all-fire and no-fire levels of an initiator are in significant part determined by the degree to which the bridgewire can release heat (and it is also determined in part by where the heat is released, i.e., fully into the charge, or also into part of the header assembly) resistively generated in it. At a certain level, the resistive heat generated by the current flowing through the bridgewire cannot be released quickly enough to prevent an increase in the temperature of the bridgewire, which may in turn cause increased heat generation in the bridgewire and then ignition. Thus, the provision of an enhanced heat sink for the bridgewire predictably increases observed all-fire and no-fire levels.

Finally, it is believed that initiators have been made with a plastic sealed feedthrough and a bridgewire lying flush against the plastic with an unconsolidated charge placed thereon. It is believed, however, that such a configuration would not likely result in enhanced heat sinking, and in any case a plastic seal is undesirable as it is generally not as hermetic and robust as a glass seal.

In these regards, it is believed that heretofore a pyrotechnic initiator has not included a bridgewire configured in an enhanced heat-sinking relationship with the adjacent ignition charge and/or header glass surface without the necessity for a consolidation force to ensure robust contact between the charge and bridgewire.

SUMMARY OF THE INVENTION

In accordance with the present invention, an initiator includes a bridgewire that is configured in an enhanced heat-sinking relationship without the necessity of a consolidation force. The bridgewire may be in an enhanced heat-sinking relationship with the adjacent ignition charge and/or the header glass surface.

DETAILED DESCRIPTION OF PREFERRED EMBODIMENTS

The present description incorporates by reference in full the disclosures of the following co-pending applications that are filed concurrently herewith and assigned to the assignee of the present application: Ser. No. 10/188,402 to Vahan Avetisian et al.; Ser. No. 10/188,004 to Vahan Avetisian et al.; Ser. No. 10/188,009 to Marius Rosu; and Ser. No. 10/188,003 to Vahan Avetisian et al. U.S. Pat. No. 5,648,634 to Avory et al. is also incorporated herein by reference. Various initiator configurations can be used, or modified appropriately for use, in the present invention. A suitable initiator for use in the present invention preferably includes a number of features typically found in pyrotechnic initiators, such as are depicted in assignee's application Ser. No. 10/188,003 by Vahan Avetisian et al., which is incorporated herein by reference. For example, a glass-to-metal sealed header assembly is hermetically attached to a charge can, an insulator cup, and a molded insulating body. And, a slurry ignition charge is loaded and dried to form a monolithic solid, preferably with a height that is a small portion of the height of the charge enclosure, preferably 0.010" to 0.080" high. For example, in a preferred embodiment having a 260 mg total charge weight, a preferable 30 mg ignition charge is a very thin layer only 0.040" high. (Using a very thin layer of slurry minimizes void formation and cracking during the drying process, thus creating a more rigid monolithic mass that has enhanced integrity with the bridgewire, which it partly or wholly encapsulates). An output charge is also preferably loaded (preferably in slurry form) on top of the ignition charge after the ignition charge has dried.

And as is taught in assignee's co-pending application Ser. No. 10/188,402 by Vahan Avetisian et al., a "slip plane" may also be provided between the ignition charge and output charge so as to prevent the transmission of forces from the output charge into the ignition charge. Also, axial spinning may be used to evenly distribute and compact one or both charges such as is taught in assignee's co-pending application Ser. No. 10/188,009 by Marius Rosu.

Figure 1:
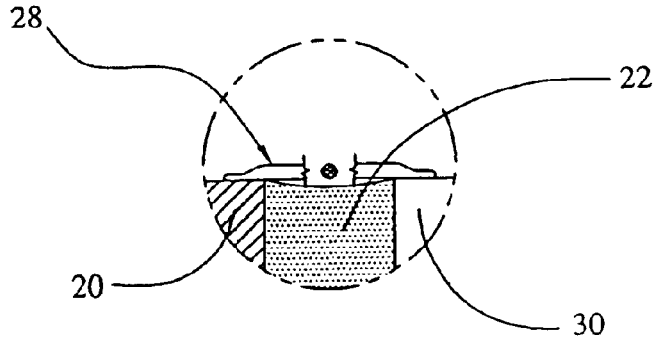
FIG. 1 is a partial side sectional view of a prior art initiator, showing a bridgewire raised above a sealed glass surface of an electrical feedthrough, with a cutaway cross-section of the bridgewire.
Figure 3:
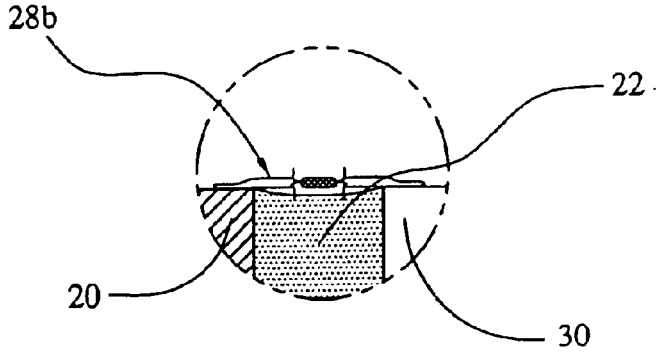
FIG. 3 is a partial side sectional view of another embodiment of the present invention, showing a bridgewire having a flattened cross-section, with a cutaway cross-section of the bridgewire.

In the prior art such as is shown in FIG. 1 (or such as is shown in FIG. 3 of U.S. Pat. No. 5,939,660 to Fogle Jr., et al., which patent is incorporated herein by reference), a header assembly includes an eyelet 20 that is typically made of a metal such as 304L stainless steel, and is generally cylindrical with a passage defined through it to permit a feedthrough to be created by the hermetic sealing of the glass 22 and the center pin 30 therein. The glass 22 may preferably consist of sodium aluminosilicate, barium alkali silicate, or other well-known glasses.

A bridgewire 28 extends from a radially extending surface of the center pin 30 to a radially extending surface of the eyelet 20. The bridgewire 28 may be formed from a high resistance metal alloy such as platinum-tungsten or "NICHROME" nickel-chromium alloy. The bridgewire 28 has flattened opposite end portions that are fixed to the center pin 30 and the eyelet 20 by electrical resistance welds. These opposite end portions of the bridgewire 28 become flattened under the pressure applied by the welding electrodes (not shown) that are used to form the resistance welds. As is shown in the cutaway at the middle of the bridgewire 28, it has an unflattened major portion that has a circular cross-section and extends between the opposite end portions. The major portion of the bridgewire 28 is bent upwardly so that it lies in a plane spaced slightly above the plane of the eyelet 20 and from the radially extending surface of the glass 22 (which includes a meniscus). A slurry ignition charge, which may preferably be zirconium/potassium perchlorate-based (not shown; also known as a primer charge), is then placed, such as in a droplet, on the surface of the header around the bridgewire 28 in a heat-receiving relationship with the bridgewire 28, and is allowed to dry to form a monolithic solid encapsulating the bridgewire 28.

Figure 2:
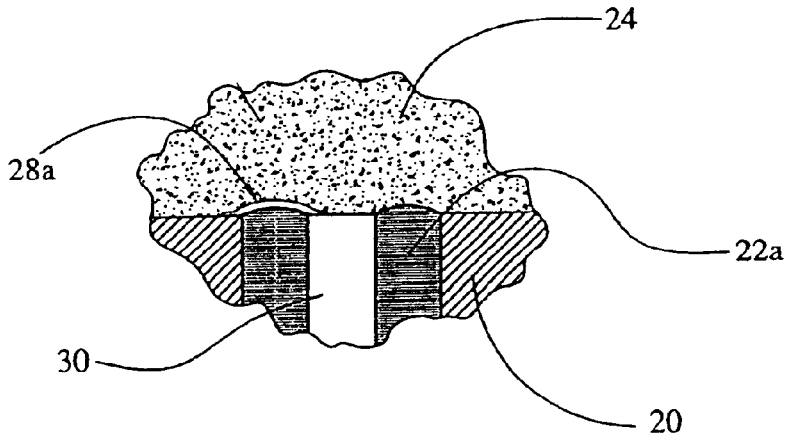
Prior Art Figure 2
FIG. 2 is partial side sectional view of an embodiment of the present invention, showing a bridgewire in intimate contact with a raised glass surface.

In contrast, in the embodiment of the present invention depicted in FIG. 2, instead of being raised above the eyelet and glass surface, the bridgewire 28*a* is in intimate contact with a glass 22*a* having a raised surface. Further, though the bridgewire 28*a*'s intimate contact with the glass 22*a* prevents it from being fully encapsulated by the ignition charge 24, since bridgewire 28*a* physically protrudes up from the header surface due to the raised surface of the glass 22*a*, there is no need for a consolidation pressure to maintain reliable contact between the bridgewire 28*a* and the charge 24 when the initiator is subjected to anticipated physical and environmental stresses. (Alternately, if a highly elastic and adhesive binder such as Nipol® is used, the glass 22*a* may be flush (not shown) with the surface of the eyelet 20, while still retaining reliable contact between the charge 24 and bridgewire). And due to the enhanced heat-sink provided by the intimate contact between the bridgewire 28*a* and the glass 22*a* (which, as noted above, typically will have a higher thermal conductivity than the charge 24), the observed all-fire and no-fire levels of the initiator are increased. (The fact that the configuration permits heat to be dissipated directly into the glass rather than solely the charge also likely contributes to increased all-fire and no-fire levels).

A suitable header for a flush glass version of the embodiment of FIG. 2 can be obtained from Schot Glass of Germany, and is commercially marketed under the SDI part number 184010. This header includes a drawn blue-colored glass. The increase in all-fire and no-fire levels in such a flush glass embodiment have been observed in the range of 100 mA as compared to the aforementioned prior art raised bridgewire and glass with meniscus configuration.

To make a convex glass configuration such as depicted in FIG. 2, a glass preform can be made having an annular top that is formed in the generally desired convex shape, according to glass processing techniques that are well-known. Such a preform can then be sealed in the header with the center pin in the conventional fashion, right-side up. Alternately, the header assembly including a flat-topped glass preform could be fixtured upside-down, and a reverse meniscus allowed to form during the heat sealing process. Alternately still, a specially formed fixture could be prepared, with an annular convex shape formed therein, and the header assembly fixtured upside down so that the glass flows to fill in the form. It is noted that the surface irregularities and voids that such a form may transmit to the surface of the glass may not be a significant drawback because as noted above, consolidation is not required to retain the charge in contact with the bridgewire according to the present invention. Accordingly, the bridgewire is not forcefully pressed against the surface of the glass and thus will not be pressed into and damaged by any voids or irregularities therein. For this reason, in either case, flush or convex, the necessity of the step of machining a smooth glass surface for the bridgewire is eliminated by virtue of the fact that the charge need not be consolidated and pressed against the bridgewire. It is also noted that the placement of the bridgewire flush against the header surface likely helps to reduce the tendency of any electrostatic discharges occurring between the eyelet and the portion of the bridgewire that is slightly raised above the eyelet, and between the pin and the portion of the bridgewire that is slightly raised above the pin.

A suitable bridgewire for the embodiment of FIG. 2 may be a platinum/tungsten wire marketed by W. C. Heraeus GmBH of Germany, with a diameter of 0.00085 inches, and a length of approximately 0.040 inches. Alternate materials could be used, such as nickel/chromium and the like. In any case, the bridgewire is preferably resistance-welded at its ends in the conventional fashion.

In another embodiment of the present invention depicted in FIG. 3, a bridgewire 28*b* is provided with a flattened cross-section through its major portion, thus increasing its degree of (surface area and thus) thermal contact for its volume, and thus enhancing its ability to release heat into its surroundings. To test this embodiment, a platinum/tungsten wire of 0.00085 inch diameter was flattened to approximately 0.012 inches wide by 0.0004 thick using a press. This wire was found to result in a 20–30 mA increase in all-fire and no-fire levels compared to a round cross-section bridgewire in the same configuration. In production, such a flattened bridgewire could readily be obtained on specification from a suitable wire vendor, which would prepare a die through which to draw the wire into the desired cross-section.

Although the configuration depicted in FIG. 3 shows a conventional raised bridgewire and glass 22 with meniscus configuration, it is noted that a flattened bridgewire can be employed in an embodiment wherein the glass does not have a meniscus, such as that of FIG. 2, resulting in a further enhanced heat sink relationship.

A preferred embodiment of a pyrotechnic initiator including a bridgewire configured in an enhanced heat-sinking relationship with the adjacent ignition charge and/or header glass surface, without the necessity of a consolidation force, has thus been disclosed. It will be apparent, however, that various changes may be made in the form, construction, and arrangement of the parts without departing from the spirit and scope of the invention, the form hereinbefore described being merely a preferred or exemplary embodiment thereof. Therefore, the invention is not to be restricted or limited except in accordance with the following claims.

What is claimed is:

1. An initiator comprising:

a) a header assembly including an eyelet, a glass insulator and a first pin defining a top surface, and an exposed electrical initiating element in intimate contact with said glass insulator; and, b) an ignition charge adjacent to said top surface of said header assembly, said ignition charge being monolithic and adjacent to and in heat-transferring relationship with said electrical initiating element, said ignition charge not being pressed against said top surface of said header assembly by a pressure of more than 50 psi.

2. The initiator of claim 1, wherein said initiator is formed to accept an output charge on top of said ignition charge.

3. The initiator of claim 2, wherein said ignition charge is formulated to facilitate the creation of an intermediary slip plane if a suitable output charge is placed atop said ignition charge.

4. The initiator of claim 2, wherein said initiator is formed to accept a charge can.

5. The initiator of claim 1, wherein said glass insulator does not have a convex top surface.

6. The initiator of claim 1, wherein said glass insulator has a convex annular top surface.

7. The initiator of claim 1, wherein said electrical initiating element is a bridgewire.

8. The initiator of claim 7, wherein said bridgewire is flattened.

9. The initiator of claim 1, wherein said ignition charge is dried from a slurry that includes a binder at less than five percent by weight and a solvent at between ten to thirty percent by weight.

10. The initiator of claim 2, wherein said ignition charge is a dried centrifuged slurry having a height of between 0.005" and 0.10".

11. The initiator of claim 4, wherein said initiator is further formed to accept a charge sleeve so as to project upwardly above said top surface of said header assembly and circumferentially surround said ignition charge.

12. A header assembly for use in an initiator, said header assembly comprising an eyelet, a first pin, and a glass insulator having a convex annular top surface and formed from a cylindrical preform, and an exposed electrical initiating element in intimate contact with said convex annular top surface of said glass insulator along substantially the major portion of said initiating element.

13. The header assembly of claim 12, wherein said electrical initiating element is a flattened bridgewire.

14. A bridgewire for use in an initiator that includes a header assembly, said bridgewire being formed of platinum/tungsten alloy and flattened to a thickness of no more than 50% of its width, wherein said bridgewire is between 0.0005 to 0.0020 inches wide and between 0.0002 to 0.0010 inches thick.

15. A header assembly for use in an initiator, said header assembly comprising an eyelet, a first pin, and a glass insulator having a top surface that is toroidal, and an exposed initiating element in intimate contact with said, toroidal top surface of said glass insulator along substantially the major portion of said initiating element.

16. The header assembly of claim 15, wherein said electrical initiating element is a flattened bridgewire.

17. A bridgewire for use in an initiator that includes a header assembly, wherein said bridgewire is a discrete piece of preformed wire having two ends that are fused onto said header assembly, wherein said wire is attached to said heading assembly only at said two ends and wherein said bridgewire is flattened to thickness of no more than 50% of its width.

18. The bridgewire of claim 17, wherein said bridgewire is between 0.0005 to 0.0020 inches wide and between 0.0002 to 0.0010 inches thick.

* * * * *